US006858995B2

(12) United States Patent
Lee et al.

(10) Patent No.: US 6,858,995 B2
(45) Date of Patent: Feb. 22, 2005

(54) ENERGY-SAVING DIMMING APPARATUS

(75) Inventors: Weon-Ho Lee, 413-703 Hwaseojugong Apt., Hwaseo-Dong, Jangan-Gu, Suwon-Si, Kyunggi-Do (KR); Kyoung-Hwa Yoon, 413-703 Hwaseojugong Apt., Hwaseo-Dong, Jangan-Gu, Suwon-Si, Kyunggi-Do (KR); Chong-Yeun Park, Chuncheon-Si (KR); Dong-Youl Jung, Kangwon-Do (KR)

(73) Assignees: Weon-Ho Lee (KR); Kyoung-Hwa Yoon (KR)

( * ) Notice: Subject to any disclaimer, the term of this patent is extended or adjusted under 35 U.S.C. 154(b) by 0 days.

(21) Appl. No.: 10/391,334

(22) Filed: Mar. 18, 2003

(65) Prior Publication Data

US 2003/0173906 A1 Sep. 18, 2003

(30) Foreign Application Priority Data

Mar. 18, 2002 (KR) ..... 2002-14365

(51) Int. Cl.[7] ..... H05B 37/02

(52) U.S. Cl. ..... 315/224; 315/291; 315/DIG. 4

(58) Field of Search ..... 315/224, 307, 315/225, 291, 209 R, DIG. 4, 200 R, 213–218, 276, 279

(56) References Cited

U.S. PATENT DOCUMENTS

| | | | | | |
|---|---|---|---|---|---|
| 5,416,387 | A | * | 5/1995 | Cuk et al. | 315/209 R |
| 5,583,402 | A | * | 12/1996 | Moisin et al. | 315/307 |
| 6,008,593 | A | * | 12/1999 | Ribarich | 315/307 |
| 2003/0160579 | A1 | * | 8/2003 | Amith et al. | 315/291 |

* cited by examiner

*Primary Examiner*—Tuyet Thi Vo
(74) *Attorney, Agent, or Firm*—Cantor Colburn LLP

(57) ABSTRACT

Disclosed is an energy-saving dimming apparatus connected to a power source and a load, and adapted to control a luminance of the load. The dimming apparatus includes a first switching unit connected to a power supply line, a second switching unit connected between the first switching unit and a ground line, a microprocessor for generating a square-wave pulse having a duty cycle according to a luminance control command, a switch driver for generating switching control signals respectively adapted to perform alternate ON/OFF controls for the switching units in accordance with the square-wave pulse inputted thereto, and a low-pass filter for removing ripple components contained in a voltage applied to the load via the first switching unit.

14 Claims, 6 Drawing Sheets

ENERGY-SAVING DIMMING APPARATUS

BACKGROUND OF THE INVENTION

1. Field of the Invention

The present invention relates to a dimming apparatus, and more particularly to an energy-saving dimming apparatus.

2. Description of the Related Art

FIG. 1 is a block diagram illustrating the configuration of a general dimming apparatus. FIG. 2 is a waveform diagram of signals outputted from the dimming apparatus of FIG. 1. As shown in FIG. 1, such a general dimming apparatus includes a luminance-controlling dimmer 10, and a ballast 20 for continuously supplying an AC voltage to a load, that is, a discharge lamp 30. The dimmer 10 serves to continuously vary the luminance or color of a light source such as a lamp. Typically, the dimmer 10 is designed to generate a voltage $V_d(t)$ shown in FIG. 2 using an auto transformer, or to generate a voltage $V_a(t)$ shown in FIG. 2 using a silicon controlled rectifier (SCR) or a triac, so as to supply the generated voltage to the ballast 20.

However, the general dimming apparatus shown in FIG. 1 has various problems.

That is, where an auto transformer is used to decrease an input voltage $V_i(t)$ to a voltage $V_d(t)$, there is a problem in that it is impossible to achieve an instantaneous voltage control. Although the auto transformer may use a tap changer adapted to cope with a variation in the input voltage $V_i(t)$, it is inefficient in terms of energy saving because it involves loss of power.

Where the dimmer 10 is configured using a semiconductor element such as an SCR or triac, a peak current $I_{peak}$ is generated when the semiconductor element is switched, as shown in FIG. 2. Such a peak current may fatally affect neighboring devices. That is, the dimmer 10, which uses a semiconductor element, allows the input voltage $V_i(t)$ to pass therethrough only during a period from t1 to t2 and a period from t3 to t4 within one cycle of the input voltage $V_i(t)$., in order to supply the voltage to the ballast 20. In this case, however, a peak current is generated at the switching points t1 and t3. This peak current may exhibit an interference effect adversely affecting other electric appliances (for example, neighboring discharge lamps).

Furthermore, in the case of the dimmer using an SCR or triac, it is difficult to achieve a desired power factor correction. For this reason, it is difficult to expect a desired energy saving effect. That is, the dimmer 10 cannot adjust the phase difference θ between voltage and current to be constant, as shown in FIG. 2, so that it is difficult to achieve a desired power factor correction. As a result, the efficiency of saving energy is lowered.

SUMMARY OF THE INVENTION

Therefore, an object of the invention is to provide a dimming apparatus capable of obtaining a maximum energy saving efficiency.

Another object of the invention is to provide a dimming apparatus capable of minimizing noise components generated when the luminance of a load is adjusted.

Another object of the invention is to provide a dimming apparatus capable of avoiding a decrease in power factor caused by adjustment of luminance, thereby minimizing loss of energy.

Another object of the invention is to provide a dimming apparatus capable of not only removing harmonic components of an input current, but also minimizing interference caused by electromagnetic waves, thereby obtaining a maximum energy saving effect.

In accordance with the present invention, these objects are accomplished by providing an energy-saving dimming apparatus connected to a power source and a load, and adapted to control a luminance of the load, comprising: a first switching unit connected to a power supply line; a second switching unit connected between the first switching unit and a ground line; a microprocessor for generating a square-wave pulse having a duty cycle according to a luminance control command; a switch driver for generating switching control signals respectively adapted to perform alternate ON/OFF controls for the switching units in accordance with the square-wave pulse inputted thereto; and a low-pass filter for removing ripple components contained in a voltage applied to the load via the first switching unit.

The dimming apparatus may further comprise a user interface for inputting the luminance control command, a level amplifier for amplifying the level of the square-wave pulse, and an electromagnetic interference filter for removing harmonic components of a current inputted via the power supply line, and removing electromagnetic interference.

BRIEF DESCRIPTION OF THE DRAWINGS

The above objects, and other features and advantages of the present invention will become more apparent after a reading of the following detailed description when taken in conjunction with the drawings, in which.

DESCRIPTION OF THE PREFERRED EMBODIMENTS

Now, preferred embodiments of the present invention will be described in detail with reference to the annexed drawings. In the following description of the present invention, a detailed description of known functions and configurations incorporated herein will be omitted when it may make the subject matter of the present invention rather unclear.

Prior to the description of the configuration and operation of a dimming apparatus according to the present invention, the principle of embodying a dimming apparatus according to an embodiment of the present invention will be described.

Figure 1:
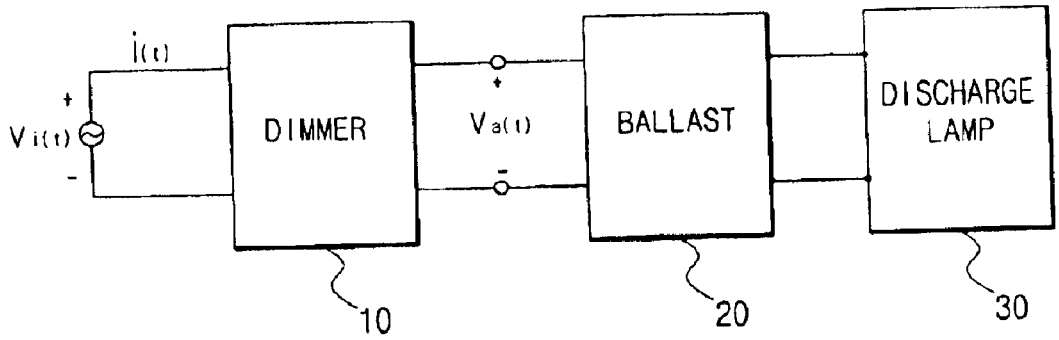
FIG 1 (Prior Art)
FIG. 1 is a block diagram illustrating the configuration of a general dimming apparatus.
Figure 2:
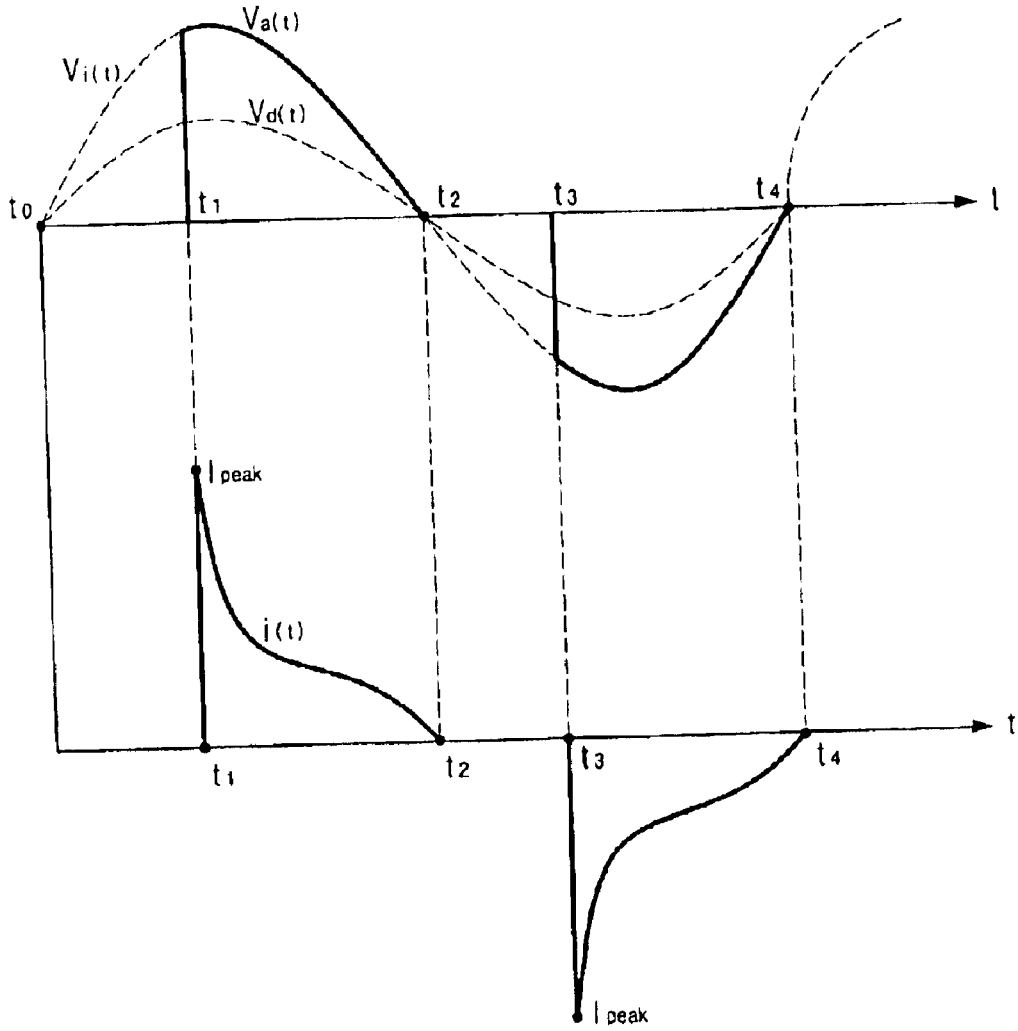
FIG 2 (Prior Art)
FIG. 2 is a waveform diagram of signals outputted from the dimming apparatus of FIG. 1.
Figure 3:
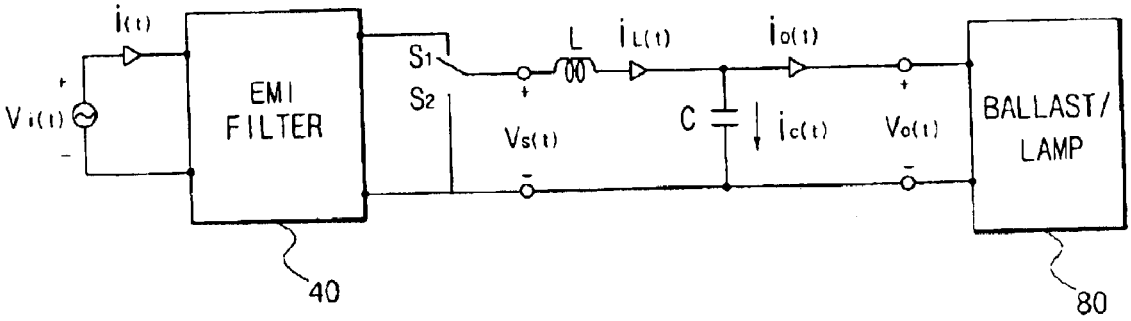
FIG. 3 is a diagram for explaining the principle of embodying the dimming apparatus according to the embodiment of the present invention.
Figure 4:
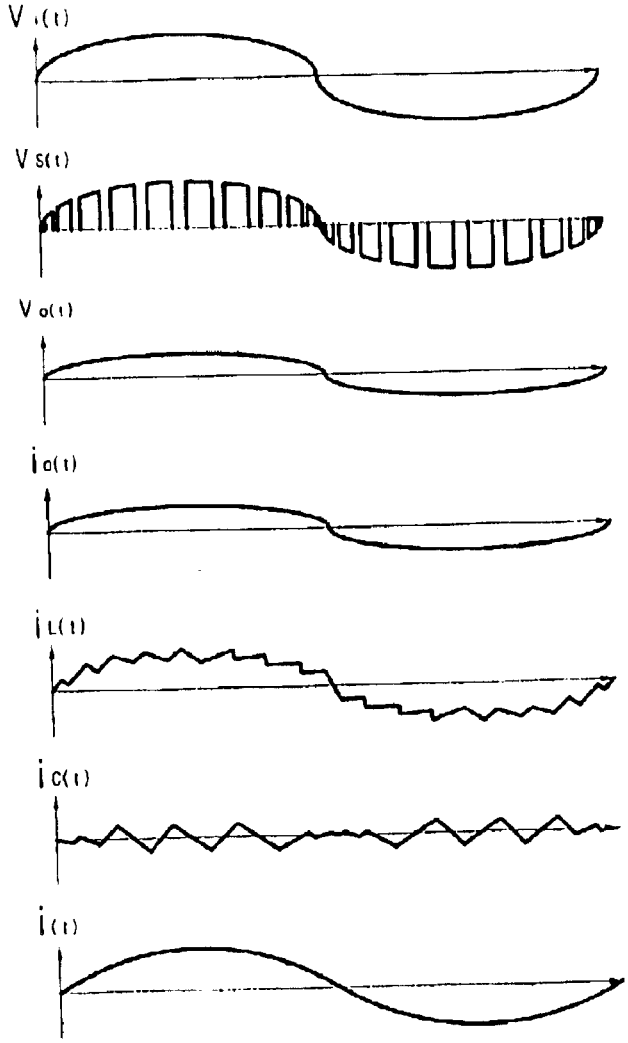
FIG. 4 is a waveform diagram illustrating current and voltage waveforms of inputs and outputs associated with respective blocks.

FIG. 3 is a diagram for explaining the principle of embodying the dimming apparatus according to the embodiment of the present invention. FIG. 4 is a waveform diagram illustrating current and voltage waveforms of inputs and outputs associated with respective blocks.

As shown in FIG. 3, the dimming apparatus according to the embodiment of the present invention includes an electromagnetic interference (EMI) filter 40, bi-directional switches $S_1$ and $S_2$, and a low-pass filter consisting of an inductor L and a capacitor C. These elements are connected between a power source supplying an input voltage $V_i(t)$ and a load (ballast/lamp) 80. A description will first be given of the voltage and current supplied to the load 80 in accordance with switching operations of the bi-directional switches $S_1$ and $S_2$, and then a description will be given of the EMI filter 40 and the elements L and C of the low-pass filter.

Where it is assumed that "$V_s(t)$" represents a voltage on an upstream terminal of the low-pass filter, that is, the LC filter, the voltage $V_s(t)$ is equal to the input voltage $V_i(t)$ when the switch $S_1$ is in its ON state, and the switch $S_2$ is in its OFF state ($V_s(t)=V_i(t)$), while being zero when the switch $S_1$ is in its OFF state, and the switch $S_2$ is in its ON state ($V_s(t)=0$). That is, as the bi-directional switches $S_1$ and $S_2$ are sequentially switched, the input voltage $V_i(t)$ is chopped at a certain sampling frequency. Thus, the voltage $V_s(t)$ is obtained which has a waveform shown in FIG. 4. Where it is assumed that the switching cycle of the voltage $V_s(t)$ is "T" in FIG. 4, the period of a duty cycle D in the switching cycle corresponds to a period in which the switch $S_1$ is in its ON state, whereas the remaining period of the switching cycle corresponds to a period in which the switch $S_1$ is in its OFF state. If the duty cycle D is constant, the voltage $V_s(t)$ contains a fundamental frequency component $V_{sf}$ corresponding to the input voltage $V_i(t)$, and a noise component $V_{sn}$, as expressed by the following Expression 1:

$$V_s(t)=V_{sf}+V_{sn} \quad \text{[Expression 1]}$$

In Expression 1, $V_{sn}$ is a frequency component having a frequency higher than that of $V_{sf}$ by about 400 to 3,500 times. This frequency component is 0 in every switching cycle when taken as a whole. Accordingly, if ripple components are completely removed by the LC filter, the output voltage $V_o(t)$ can be expressed by the following Expression 2:

$$V_o(t)=V_{sf}=DV_i(t) \quad \text{[Expression 2]}$$

Meanwhile, ripple components $\Delta V_o$ can be derived, as expressed by the following Expression 3. Referring to Expression 3, it can be understood that the ripple components $\Delta V_o$ are reduced as the value of "LC" increases, or the value of "T" increases. In Expression 3, "DT" represents a pulse width.

$$\Delta V_o = \frac{1}{LC}\frac{\left|V_i(i-D)DT^2\right|}{\delta} \quad \text{[Expression 3]}$$

Where it is assumed that the load stage including a ballast and a lamp is an ideal resistor R, the output current $i_o(t)$ can obtain a current waveform shown in FIG. 4. Under the condition in which the switch $S_1$ is in its ON state, and the switch $S_2$ is in its OFF state, that is, during the period of $0 \leqq t \leqq DT$, and if the ripple components of the output voltage $V_o(t)$ are ignored, the following Expression 4 is established for the current $i_L(t)$ flowing through the inductor L:

$$\frac{d}{dt}i_L(t) = \frac{1}{L}\left[V_i(t)-V_0(t)\right] = \frac{1}{L}(1-D)V_i(t) \quad \text{[Expression 4]}$$

Accordingly, a variation in the inductor current $i_L$ during the DT period can be expressed by the following Expression 5. When $V_i$ has a positive (+) value, $i_L$ increases. On the contrary, $i_L$ decreases when $V_i$ has a negative (−) value.

$$\Delta i_L = D(1-D)\frac{V_i}{L}T \quad \text{[Expression 5]}$$

In a period of $DT \leqq t \leqq T$, that is, a period in which the switch $S_1$ is in its OFF state, and the switch $S_2$ is in its ON state, the following Expression 6 is established for the inductor current $i_L$:

$$\frac{d}{dt}i_L(t) = \frac{V_0(t)}{L} = -D\frac{V_i(t)}{L} \quad \text{[Expression 6]}$$

Accordingly, a variation in the inductor current $i_L$ during the remaining switching period, $\Delta i_L$, can be expressed by the Expression 4. When $V_i(t)$ has a positive (+) value, $i_L(t)$ decreases. On the contrary, $i_L(t)$ increases when $V_i(t)$ has a negative (−) value.

Therefore, where it is assumed that the input voltage $V_i(t)$ is constant at 220V/60 Hz, the increase and decrease in inductor current occurring during one cycle (1/60 sec) are the same. The waveform of the current $i_L(t)$ is shown in FIG. 4.

Meanwhile, where the LC filter operates ideally, its capacitor C completely transmits the fundamental frequency component of the current flowing through the inductor L, that is, the frequency component identical to the input frequency (60 Hz), while completely absorbing the ripple current $\Delta i_L$ of the inductor L caused by switching operations. The current $i_c(t)$ of the capacitor C becomes the ripple component of $i_L(t)$. The current of the capacitor C for one switching cycle can be expressed by the following Expressions 7 and 8. The waveform of the current $i_c(t)$ is shown in FIG. 4.

$$i_c(t) = \Delta i_L(t)\frac{t}{DT} - \frac{\Delta i_L(t)}{2} \quad \text{[Expression 7]}$$

$$i_c(t) = -\Delta i_L(t)\frac{t-DT}{(1-D)T} + \frac{1}{2}\Delta i_L(t) \quad \text{[Expression 8]}$$

Accordingly, the inductor current $i_L(t)$ in a normal state corresponds to the sum of $i_c(t)$ and $i_o(t)$. This can be expressed by the following Expressions 9 and 10. The waveform of the inductor current $i_L(t)$ is shown in FIG. 4.

$$i_L(t) = i_0(t) + \Delta i_L(t)\frac{t}{DT} - \frac{\Delta i_L(t)}{2} \quad \text{[Expression 9]}$$

$$i_L(t) = i_0(t) - \Delta i_L(t)\frac{t-DT}{(1-D)T} + \frac{1}{2}\Delta i_L(t) \quad \text{[Expression 10]}$$

The input current i(t) corresponding to the input voltage $V_i(t)$ has the same waveform as that obtained after $i_L(t)$ shown in FIG. 4 is low-pass filtered by the EMI filter 40. The waveform of the input current i(t) is shown in FIG. 4.

The input current i(t) corresponding to the input voltage Vi(t) has the same waveform as that obtained after $i_L(t)$ shown in FIG. 4 is low-pass filtered by the EMI filter 40. The waveform of the input current i(t) is shown in FIG. 4.

Now, the configuration and operation of the dimming apparatus designed in accordance with the above described dimming apparatus embodying principle will be described.

Figure 5:
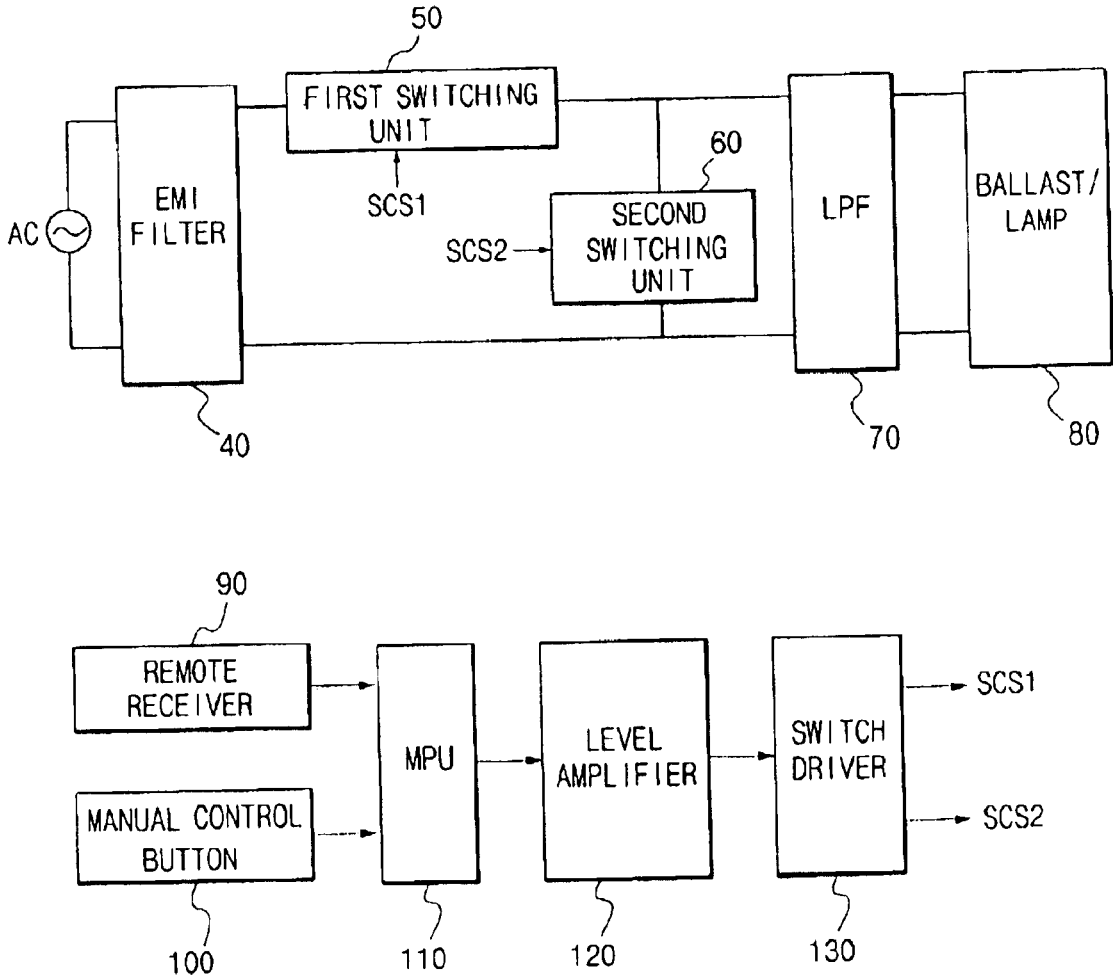
FIG. 5 is a block diagram illustrating the dimming apparatus according to the embodiment of the present invention.
Figure 6:
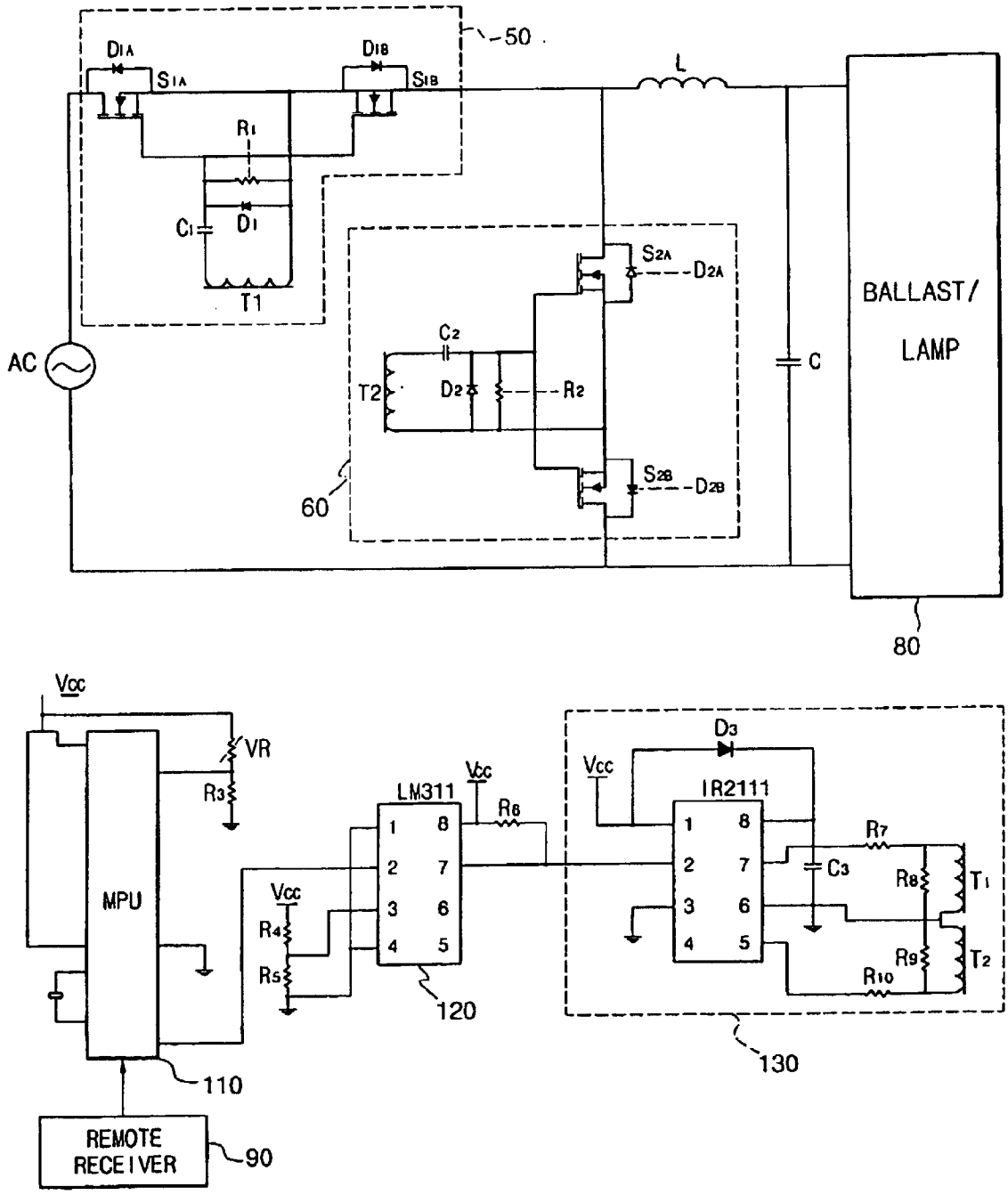
FIG. 6 is a circuit diagram of a part of the dimming apparatus shown in FIG. 5.
Figure 7:
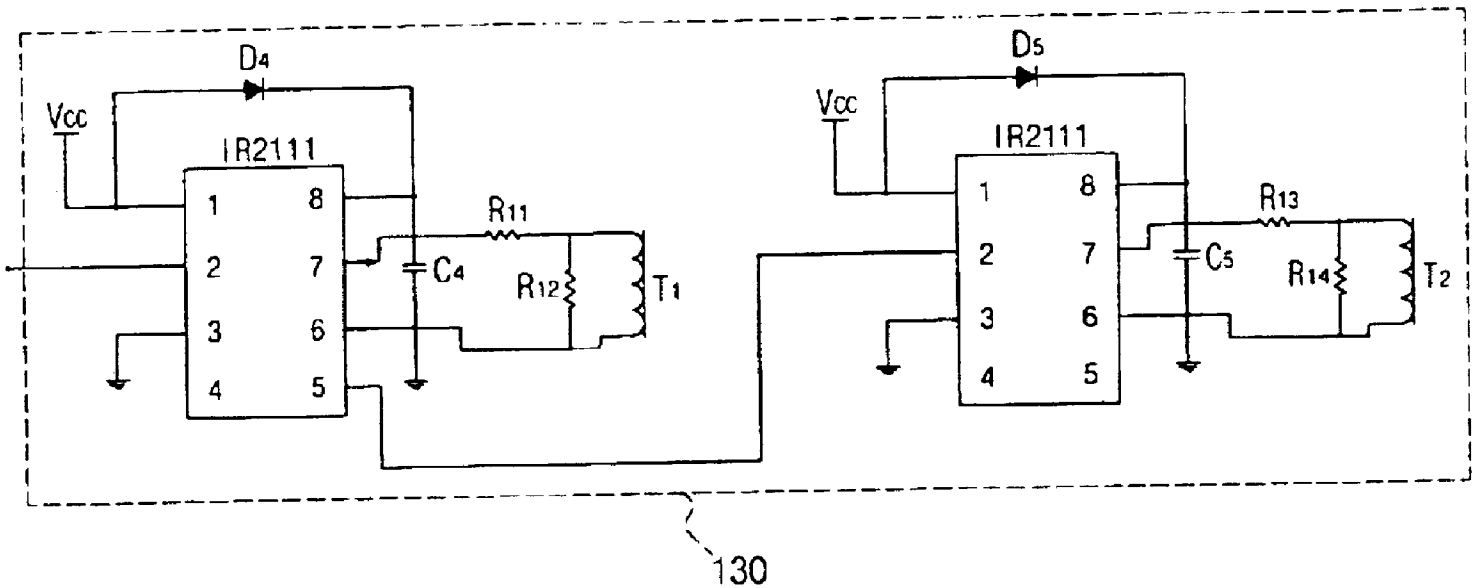
FIG. 7 is a circuit diagram illustrating a switch driver included in the dimming apparatus in accordance with another embodiment of the present invention.
Figure 8:
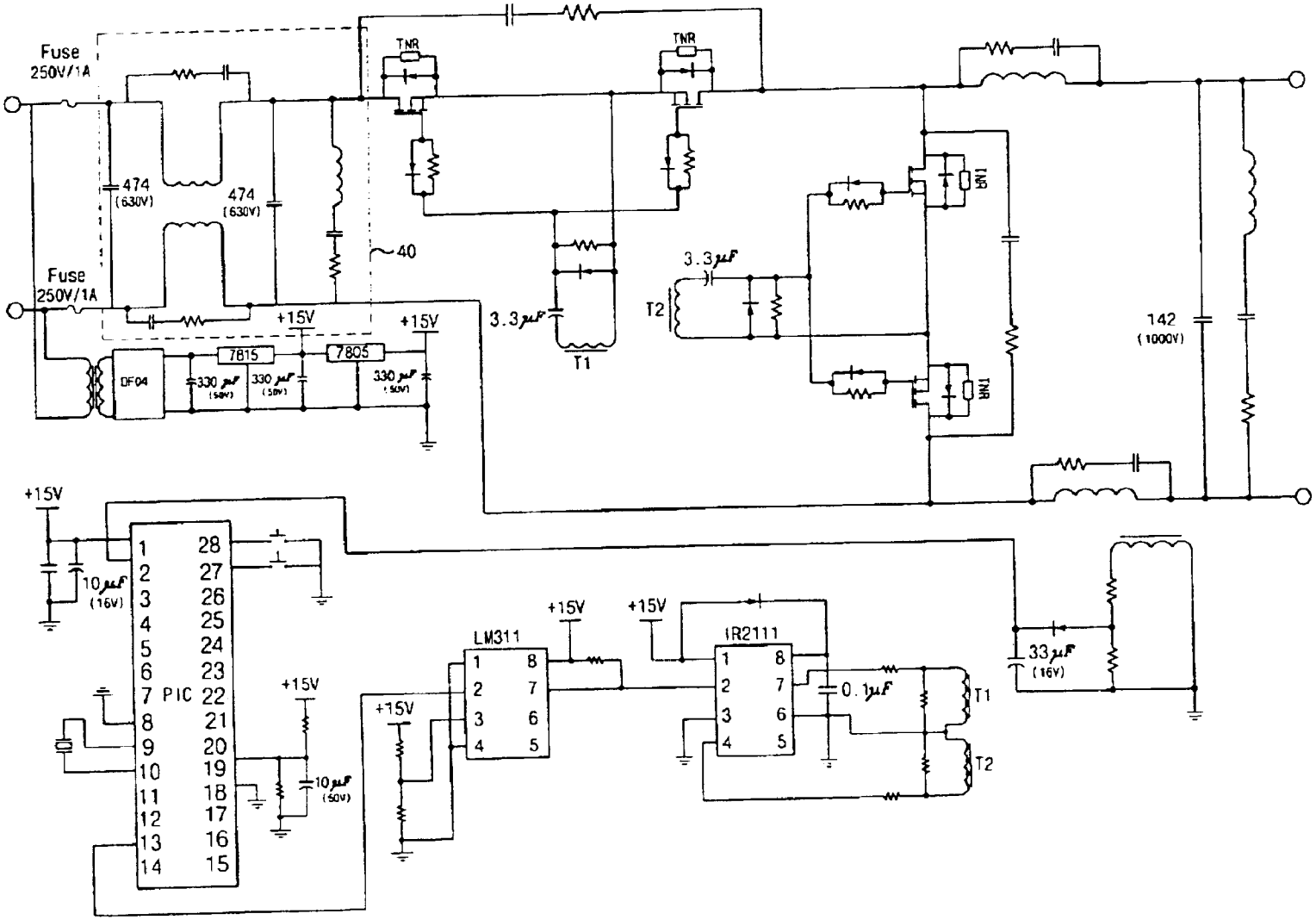
FIG. 8 is a circuit diagram illustrating the entire configuration of the dimming apparatus shown in FIG. 5.

FIG. 5 is a block diagram illustrating the dimming apparatus according to the embodiment of the present invention. FIG. 6 is a circuit diagram of a part of the dimming apparatus shown in FIG. 5. FIG. 7 is a circuit diagram illustrating a switch driver included in the dimming apparatus in accordance with another embodiment of the present invention. FIG. 8 is a circuit diagram illustrating the entire configuration of the dimming apparatus shown in FIG. 5.

Referring to FIG. 5, the EMI filter 40 serves to filter harmonic components of a current inputted from a commercial AC power source AC via a power supply line, while removing electromagnetic interference.

A first switching unit 50 is connected to an output terminal of the EMI filter 40. The first switching unit 50 is controlled to be switched on/off in response to a switching control signal SCS1 generated under the control of a microprocessor unit (MPU) 110. As shown in FIG. 6, the first switching unit 50 includes two NMOS type field effect transistors S1A and S1B. The gate of each field effect transistor is connected to the secondary-side output terminal of a transformer T1, which will be described hereinafter. Connected to the secondary-side output terminal of the transformer T1 are also a capacitor $C_1$ for amplifying a secondary-side induced voltage, a resistor $R_1$ for discharging a parasitic capacitor of each field effect transistor, and a reverse-current preventing diode $D_1$. The reason why two switching elements are used is to solve problems occurring when a single switching element is used, for example, a failure of the switching element caused by overheating.

The second switching unit 60 is connected between the output terminal of the first switching unit 50 and a ground line. The second switching unit 60 has the same configuration as the first switching unit 50, and is controlled to be switched on/off in response to a switching control signal SCS2 generated under the control of the MPU 110.

On the other hand, the low-pass filter 70, which consists of one inductor L and one capacitor C, as described with reference to FIG. 3, filters noise components generated in accordance with switching operations of the first switching unit 50, thereby supplying a stable voltage to the load, that is, the ballast/lamp 80. That is, the low-pass filter 70 removes noise components contained in an applied voltage.

Referring to FIG. 5, a remote receiver 90, which is a user interface, is shown. This remote receiver 90 receives a luminance control signal transmitted from a remote controller, and transmits the received signal to the MPU 110. The MPU 110 also receives a luminance control command generated from another user interface, that is, a manual control button 100, in accordance with a manipulation of the user. The manual control button 100 may be configured using a variable resistor VR, as shown in FIG. 6.

The MPU 110 generates a square-wave pulse having a duty cycle D according to the luminance control command received from the associated user interface. In accordance with such a duty cycle control, the ON/OFF times of the first and second switching units 50 and 60 are variable. Thus, the level of the voltage supplied to the ballast is variable in accordance with the controlled ON/OFF times of the first and second switching units 50 and 60.

A level amplifier 120 is connected to the MPU 110 in order to amplify the level of the square-wave pulse (5V) outputted from the MPU 110 to a desired level (12V), and to output the amplified square-wave pulse to a switch driver 130. The level amplifier 120 may be implemented using an OP amplifier LM311, as shown in FIG. 6.

The switch driver 130 generates the switching control signals SCS1 and SCS2 respectively adapted to perform alternate ON/OFF controls for the switching units 50 and 60 in accordance with the amplified square-wave pulse inputted thereto. As shown in FIG. 6, the switch driver 130 includes a switch driving IC IR2111 for outputting the switching control signals SCS1 and SCS2 having different logic levels at ports thereof (7th and 5th ports) in accordance with the level of the square-wave pulse inputted thereto, respectively, and two transformers T1 and T2 for transferring the switching control signals SCS1 and SCS2 outputted form the switch driving IC IR2111 to respective gates of the switching units 50 and 60. When the switching control signals SCS1 and SCS2 respectively having a "high" level and a "low" level are outputted at the 7th and 5th ports of the switch driving IC IR2111, a certain voltage is induced at the secondary winding of the transformer T1, thereby causing the first switching unit 50 to be switched to its "switching-on" state. At this time, the second switching unit 60 is switched to its "switching-off" state.

Where both the transformers T1 and T2 are controlled by the single switch driving IC IR2111, as shown in FIG. 6, it is impossible to avoid effects of interference occurring between the transformers T1 and T2. Accordingly, an additional switch driving IC may be provided so that the transformers are matched with the switch driving ICs, respectively, as shown in FIG. 7. In this case, the amplified square-wave pulse may be applied to the switch driving ICs in such a fashion that it is applied, via one switch driving IC, to another switch driving IC. Alternatively, the amplified square-wave pulse may be directly applied to both the switch driving ICs. In either case of FIG. 6 or FIG. 7, the ON/OFF control for the first and second switching units 50 and 60 should be achieved, taking into consideration dead times.

The operation of the dimming apparatus having the above described configuration will now be described.

When the user enters a luminance control command by manipulating the manual control button 100, that is, when the resistance of the variable resistor VR shown in FIG. 6 is varied in accordance with a manipulation of the user, a voltage having a level corresponding to the varied resistance is inputted to the MPU 110. The input voltage is converted into a digital signal by an A/D converter. In this manner, the MPU 110 receives the luminance control command entered by the user. In response to the luminance control command, the MPU 110 outputs a square-wave pulse having a controlled duty cycle. The square-wave pulse having a certain duty cycle is applied to the switch driver 130 after being amplified by the level amplifier 120.

The switch driving IC IR2111 of the switch driver 130 outputs switching control signals respectively having a "high" level and a "low" level at its 7th and 5th ports, in a "high" duration of the square-wave pulse. In response to these switching control signals, a certain voltage is induced at the secondary winding of the transformer T1. The induced voltage is applied to the gate of the first switching unit 50, thereby causing the first switching unit 50 to be switched on. At this time, the second switching unit 60 is maintained in its OFF state. On the other hand, in a "low" duration of the square-wave pulse, the switch driving IC IR2111 outputs switching control signals respectively having a "low" level and a "high" level at its 7th and 5th ports. In response to these switching control signals, the first switching unit 50 is switched off, and the second switching unit 60 is switched on. As the second switching unit 60 is switched on, current is continuously supplied to the ballast of the load 80. Thus, continuous current supply is achieved.

If the square-wave pulse having a constant duty cycle is continuously generated, the input voltage Vi(t) inputted via the power supply line is chopped, as shown in FIG. 4, and then applied to an LPF 70. In the LPF 70, noise components caused by switching operations are removed. Accordingly, a stable current is continuously supplied to the ballast of the load 80. Thus, it is possible to reliably control the luminance of the lamp.

As apparent from the above description, the present invention provides an advantage in that it is possible to achieve an instantaneous luminance control, as compared to auto transformers used for a luminance control. It is also possible to expect a relative energy saving effect because there is no energy loss caused by any power loss occurring at transformers.

Where the dimming apparatus is configured using an element such as an SCR or triac, it is possible to suppress generation of an excessive peak current $T_{peak}$. Accordingly, there is an advantage in that it is possible to prevent neighboring devices from being damaged due to any excessive peak current.

In accordance with the present invention, there is no phase difference between the voltage and current applied to the load at the point of time when a luminance control is carried out. Accordingly, it is possible to minimize loss of energy caused by a decrease in power factor, even when luminance is lowered. As a result, there is an advantage of achieving a maximum energy saving effect.

In addition, there is an advantage in that it is possible to remove noise components generated upon adjusting the luminance of the load, using an LC filter, thereby minimizing affects caused by noise. In accordance with the present invention, an EMI filter is used at the power input stage. By this EMI filter, it is possible to remove the harmonic frequency components of an input current while minimizing interference caused by electromagnetic waves.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An energy-saving dimming apparatus connected to a power source and a load, and adapted to control a luminance of the load, comprising:

a first switching unit connected to a power supply line;

a second switching unit connected between the first switching unit and a ground line;

a microprocessor for generating a square-wave pulse having a duty cycle according to a luminance control command;

a switch driver for generating switching control signals respectively adapted to perform alternate ON/OFF controls for the switching units in accordance with the square-wave pulse inputted thereto;

a low-pass filter for removing ripple components contained in a voltage applied to the load via the first switching unit; and a level amplifier for amplifying a level of the square-wave pulse.

2. The energy-saving dimming apparatus according to claim 1, wherein each of the first and second switching units is a field effect transistor adapted to be switched on/off in accordance with an associated one of the switching control signals applied to a gate thereof.

3. The energy-saving dimming apparatus according to claim 1, wherein the low-pass filter is an LC filter.

4. The energy-saving dimming apparatus according to claim 1, further comprising:

an electromagnetic interference filter for removing harmonic components of a current supplied via the power supply line, and removing electromagnetic interference.

5. The energy-saving dimming apparatus according to claim 4, wherein each of the first and second switching units comprises two field effect transistors connected to the power supply line at respective drains thereof, and connected to each other at respective sources thereof, the field effect transistors receiving the switching control signals at the drains thereof, respectively.

6. The energy-saving dimming apparatus according to claim 4, wherein each of the first and second switching units is a field effect transistor adapted to be switched on/off in accordance with an associated one of the switching control signals applied to a gate thereof.

7. The energy-saving dimming apparatus according to claim 4, wherein the low-pass filter is an LC filter.

8. The energy-saving dimming apparatus according to claim 1, wherein each of the first and second switching units comprises two field effect transistors connected to the power supply line at respective drains thereof; and connected to each other at respective sources thereof, the field effect transistors receiving the switching control signals at the drains thereof, respectively.

9. The energy-saving dimming apparatus according to claim 8, wherein the switch driver comprises:

a switch driving IC for outputting, at two ports, switching control signals having different logic levels in accordance with a logic level of the square-wave pulse inputted thereto, respectively; and two transformers for transferring the switching control signals outputted from the switch driving IC to the gates of the field effect transistors, respectively.

10. The energy-saving dimming apparatus according to claim 9, wherein the switch driver further comprises:

a capacitor provided at a secondary winding of each of the transformers, and adapted to amplify a voltage induced at the secondary winding of the transformer; and a resistor provided at the secondary winding of the transformer, and adapted to discharge a parasitic capacitor of an associated one of the field effect transistors.

11. The energy-saving dimming apparatus according to claim 8, wherein the switch driver comprises:

a first switch driving IC for outputting a switching control signal having the same logic level as that of the square-wave pulse inputted thereto;

a first transformer for transferring the switching control signal outputted from the first switch driving IC to the gate in the first switching unit;

a second switch driving IC for outputting a switching control signal having a logic level inverse to that of the square-wave pulse inputted thereto; and a second transformer for transferring the switching control signal outputted from the second switch driving IC to the gate in the second switching unit.

12. The energy-saving dimming apparatus according to claim 11, wherein the switch driver further comprises:

a capacitor provided at a secondary winding of each of the transformers, and adapted to amplify a voltage induced at the secondary winding of the transformer; and a resistor provided at the secondary winding of the transformer, and adapted to discharge a parasitic capacitor of an associated one of the field effect transistors.

13. A dimming apparatus comprising:

an electromagnetic interference filter for removing harmonic components of a current inputted via a power supply line, and removing electromagnetic interference;

a first switching unit connected to an output terminal of the electromagnetic interference filter;

a second switching unit connected between an output terminal of the first switching unit and a ground line;

a user interface for inputting a luminance control command;

a microprocessor for generating a square-wave pulse having a duty cycle according to the luminance control command;

a level amplifier for amplifying a level of the square-wave pulse;

a switch driver for generating switching control signals respectively adapted to perform alternate ON/OFF controls for the switching units in accordance with the square-wave pulse inputted thereto; and a low-pass filter for removing ripple components contained in a voltage applied to the load via the first switching unit.

14. The dimming apparatus according to claim 13, wherein the user interface comprises:

a remote receiver for receiving a signal transmitted from a remote controller; and a variable resistor having a resistance variable in accordance with a manual operation.

* * * * *